US008518555B2

(12) United States Patent
Date

(10) Patent No.: US 8,518,555 B2
(45) Date of Patent: Aug. 27, 2013

(54) PLATED STEEL SHEET FOR CANS

(75) Inventor: Hiromitsu Date, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 348 days.

(21) Appl. No.: 12/735,714

(22) PCT Filed: Feb. 16, 2009

(86) PCT No.: PCT/JP2009/053106
§ 371 (c)(1),
(2), (4) Date: Aug. 10, 2010

(87) PCT Pub. No.: WO2009/104773
PCT Pub. Date: Aug. 27, 2009

(65) Prior Publication Data

US 2010/0310898 A1 Dec. 9, 2010

(30) Foreign Application Priority Data

Feb. 18, 2008 (JP) ..... 2008-036281

(51) Int. Cl.
*B32B 15/04* (2006.01)
*B32B 15/18* (2006.01)

(52) U.S. Cl.
USPC ..... 428/633; 428/646; 428/648; 428/684; 428/219; 428/340; 428/332

(58) Field of Classification Search
USPC ..... 428/632, 633, 646, 648, 684, 685, 428/687, 680, 215, 219, 220, 340, 332, 704
See application file for complete search history.

(56) References Cited

FOREIGN PATENT DOCUMENTS

| | | |
|---|---|---|
| GB | 2 020 695 A | 11/1979 |
| JP | 52-68832 | 6/1977 |
| JP | 52-075626 | 6/1977 |
| JP | 52-75626 | 6/1977 |
| JP | 52-92837 | 8/1977 |
| JP | 2000-226676 | 8/2000 |
| JP | 2001-316851 | 11/2001 |
| JP | 2002-206191 | 7/2002 |
| JP | 2002-275643 | 9/2002 |
| JP | 2002-275657 | 9/2002 |
| JP | 2002-285354 | 10/2002 |
| JP | 2002-339081 | 11/2002 |
| JP | 2003-003281 | 1/2003 |
| JP | 2003-082497 | 3/2003 |
| JP | 2003-175564 | 6/2003 |
| JP | 2003-183853 | 7/2003 |
| JP | 2003-239084 | 8/2003 |
| JP | 2003-253466 | 9/2003 |
| JP | 2004-68063 | 3/2004 |
| WO | WO 2007/111354 | 10/2007 |

OTHER PUBLICATIONS

Machine Translation, Date, JP 2003-082497, Mar. 2003.*
Chinese Office Action dated Jul. 26, 2011, issued in corresponding Chinese Patent Application No. 200980105477.3.
International Search Report dated Mar. 17, 2009 issued in corresponding PCT Application No. PCT/JP2009/053106.

* cited by examiner

*Primary Examiner* — Micahel La Villa
(74) *Attorney, Agent, or Firm* — Kenyon & Kenyon LLP

(57) ABSTRACT

Plated steel sheet comprised of steel sheet having a tin alloy layer on it, which is characterized by (i) having free tin distributed on the tin alloy layer in a 5 to 97% area rate and further (ii) having a chemically treated layer having phosphate in an amount of 1.0 to 5.0 mg/m$^2$ in terms of P and tin oxide in an amount of 0.3 to 4.0 mC/cm$^2$ in terms of electricity necessary for reduction, formed on the tin alloy layer and free tin.

5 Claims, No Drawings

PLATED STEEL SHEET FOR CANS

This application is a national stage application of International Application No. PCT/JP2009/053106, filed 16 Feb. 2009, which claims priority to Japanese Application No. 2008-036281, filed 18 Feb. 2008, which is incorporated by reference in its entirety.

TECHNICAL FIELD

The present invention relates to a plated steel sheet for cans superior in adhesion with an organic film after storage under the wet condition and corrosion resistance used for beverage cans, food cans, etc. and a method of production of the same.

BACKGROUND ART

In the past, the surface treated steel sheet used as a can material was mainly tin-plated steel sheet such as tin-plated and lightly-coated steel sheet, or nickel plated steel sheet, and electrolytic chromium coated steel (ECCS).

Usually, the plated surfaces of these steel sheets are chemically treated to thereby secure adhesion to a lacquer or resin film.

At the present, almost all chemical treatment of the commercialized surface treated steel sheet for cans is dipping or cathodic electrolysis using an aqueous solution mainly comprised of dichromate or chromic acid or cathodic electrolysis.

As exceptional treatment, Japanese Patent Publication (A) No. 52-68832 and Japanese Patent Publication (A) No. 52-75626 disclose "cathodic-anodic electrolysis in a tin phosphate aqueous solution", but the applications are limited to cans for powdered milk used as is with the inside surface uncoated.

The main reason why cathodic-anodic electrolysis is not used for beverage cans and food cans other than cans for powdered milk is that adhesion with an organic film like a lacquer or resin film is insufficient.

On the other hand, the chromium (III) oxide film obtained by dipping using an aqueous solution mainly comprised of dichromate or chromic acid or cathodic electrolysis has a large effect of improvement of the adhesion with an organic film. Various chemical treatments for replacing this have been studied, but none have been put into practical use.

For example, Japanese Patent Publication (A) No. 52-92837 discloses a method of anodic treatment in a phytic acid or phytate solution.

In recent years, numerous technologies for providing a tin-plating layer with a film using a silane coupling agent have been disclosed.

For example, Japanese Patent Publication (A) No. 2002-285354 discloses steel sheet or cans comprised of tin-plated steel sheet with Sn layers or Fe—Sn alloy layers on which layers of a silane coupling agent have been coated, while Japanese Patent Publication (A) No. 2001-316851 discloses tin-plated steel sheet comprised of a tin-plating layer on which an inner layer of a chemical converted film containing P and Sn and an outer layer of a silane coupling layer are provided.

Further, art similar to the art disclosed in Japanese Patent Publication (A) No. 2001-316851 is disclosed in Japanese Patent Publication (A) No. 2002-275643, Japanese Patent Publication (A) No. 2002-206191, Japanese Patent Publication (A) No. 2002-275657, Japanese Patent Publication (A) No. 2002-339081, Japanese Patent Publication (A) No. 2003-3281, Japanese Patent Publication (A) No. 2003-175564, Japanese Patent Publication (A) No. 2003-183853, Japanese Patent Publication (A) No. 2003-239084, Japanese Patent Publication (A) No. 2003-253466, an Japanese Patent Publication (A) No. 2004-68063.

DISCLOSURE OF THE INVENTION

None of the chemical films described in Japanese Patent Publication (A) No. 52-68832 and Japanese Patent Publication (A) No. 52-75626 can really be said to be provided with the performance required for using plated steel sheet for coated can use such as adhesion with an organic film after storage under the wet condition (secondary adhesion) and corrosion resistance.

Further, the arts described in Japanese Patent Publication (A) No. 52-92837, Japanese Patent Publication (A) No. 2002-285354, Japanese Patent Publication (A) No. 2001-316851, Japanese Patent Publication (A) No. 2002-275643, Japanese Patent Publication (A) No. 2002-206191, Japanese Patent Publication (A) No. 2002-275657, Japanese Patent Publication (A) No. 2002-339081, Japanese Patent Publication (A) No. 2003-3281, Japanese Patent Publication (A) No. 2003-175564, Japanese Patent Publication (A) No. 2003-183853, Japanese Patent Publication (A) No. 2003-239084, Japanese Patent Publication (A) No. 2003-253466, and Japanese Patent Publication (A) No. 2004-68063 use expensive chemicals, are difficult to be used practically and industrially, because the manufacturing cost becomes extremely high compared with the prior art as using a high-cost chemical agent.

Therefore, the present invention has as its object the provision of a plated steel sheet for cans superior in secondary adhesion with an organic film and corrosion resistance by chemical treatment using a low cost phosphate solution and a method of production of the same.

The inventors engaged in studies to achieve the above object. As a result, the inventors figured a film structure of a tin-plated steel sheet with an extremely good secondary adhesion with an organic film and a method able to realize this film structure at a low cost and thereby completed the present invention.

The gist of the present invention is as follows:

(1) A tin-plated steel sheet for cans comprised of a steel sheet having a tin alloy layer on it, the tin-plated steel sheet characterized by (i) having free tin distributed on the tin alloy layer in a 5 to 97% area rate and further (ii) having a chemically treated layer having phosphate in an amount of 1.0 to 5.0 $mg/m^2$ in terms of P and tin oxide in an amount of 0.3 to 4.0 $mC/cm^2$ in terms of electricity necessary for reduction, formed on the tin alloy layer and free tin.

(2) A tin-plated steel sheet for cans as set forth in (1), characterized in that the phosphate includes iron phosphate.

(3) A tin-plated steel sheet for cans as set forth in (1), characterized in that the phosphate includes tin phosphate.

(4) A tin-plated steel sheet for cans as set forth in any one of (1) to (3), characterized in that the tin alloy layer is comprised of one or both of an Fe—Sn alloy layer containing in an amount of 0.1 to 2.0 $g/m^2$ and an Fe—Ni—Sn alloy layer containing nickel in an amount of 2 to 100 $mg/m^2$.

(5) A tin-plated steel sheet for cans as set forth in any one of (1) to (4), characterized in that a total of the free tin and tin in the tin alloy is 0.5 to 12 $g/m^2$.

(6) A method of plating steel sheet to produce a tin-plated steel sheet for cans, the method of production of a tin-plated steel sheet for cans characterized by;

(a) electrolytic tin-plating the steel sheet, then heat-melting the tin, then (b) treating it by cathodic electrolysis in an aqueous phosphate solution having a solution temperature of 30 to 50° C. and a pH of 1.5 to 3.5 at 2 to 30 A/dm$^2$ for 0.1 to 2 sec., next, (c) treating it by anodic electrolysis within 5 sec. after the above treatment in an aqueous phosphate solution having a solution temperature of 30 to 50° C. and a pH of 1.5 to 3.5 at 0.2 to 5 A/dm$^2$ for 0.1 to 2 sec., and (d) treating it by cathodic electrolysis in an aqueous phosphate solution having a solution temperature of 30 to 50° C. and a pH of 1.5 to 3.5 at 1 to 30 A/dm$^2$ for 0.1 to 2 sec.

(7) A method of production of a tin-plated steel sheet for cans as set forth in (6), characterized in that the aqueous phosphate solution contains one or more of cations such as sodium ions, potassium ions, calcium ions, magnesium ions, and ammonium ions.

(8) A method of production of a tin-plated steel sheet for cans as set forth in (6) or (7), characterized by plating electrolytic Fe—Ni alloy plating or electrolytic Ni plating including an amount of Ni of 2 to 100 mg/m$^2$ before the electrolytic tin-plating.

According to the present invention, it is possible to provide a tin-plated steel sheet for cans having a film structure with an extremely good secondary adhesion with an organic film and corrosion resistance and a method of production producing this steel sheet at a low cost.

BEST MODE FOR CARRYING OUT THE INVENTION

Below, the present invention will be explained in detail.

The type of the steel sheet used in the present invention does not have to be particularly limited. The aluminum killed steel or low carbon steel or other steel sheet used for can-use steel sheet in the past can be used without any problem. It is sufficient to select the thickness and temper designation of the steel sheet in accordance with the objective of use.

The main constitution of the present invention is a tin-plated steel sheet comprised of a steel sheet having a tin alloy layer on it, (i) having free tin distributed on the tin alloy layer in a 5 to 97% area rate and further (ii) having a chemically treated layer having phosphate in an amount of 1.0 to 5.0 mg/m$^2$ in terms of P and tin oxide in an amount of 0.3 to 4.0 mC/cm$^2$ in terms of electricity necessary for reduction, formed on the tin alloy layer and free tin.

The amount of tin oxide has to be 0.3 to 4.0 mC/cm$^2$ in terms of the quantity of electricity required for reduction. The amount of electricity required for reduction of the tin oxide can be determined from a potential-time curve obtained by cathodic electrolysis of tin-plated steel sheet at a constant current of 0.05 mA/cm$^2$ in a 0.001 mol/L hydrobromic acid solution which dissolved oxygen is removed by means such as bubbling of nitrogen gas.

Tin oxide is mainly present on the surface of free tin on which no tin phosphate layer is formed. Microscopically, tin phosphate and tin oxide are distributed on the free tin.

Tin oxide joins the organic film to the free tin where no tin phosphate layer has been formed, so is essential for improvement of the adhesion of the organic film.

If the amount of tin oxide is smaller than 0.3 mC/cm$^2$ by quantity of electricity required for reduction of the tin oxide, it is not possible to secure adhesion at the interface of the free tin and organic film.

On the other hand, if the amount of tin oxide exceeds 4.0 mC/cm$^2$, the ratio of the tin oxide on the free tin becomes higher, the ratio of the tin phosphate with the higher effect of improvement of adhesion falls, cohesive failure easily occurs in the tin oxide layer, and the secondary adhesion with an organic film falls.

From the viewpoint of securing secondary adhesion with an organic film, the amount of tin oxide is more preferably from 0.3 to 3.0 mC/cm$^2$ in terms of the quantity of electricity required for reduction.

The amount of phosphate has to be 1.0 to 5.0 mg/m$^2$ in term of P. The amount of P can be measured by the fluorescent X-ray analysis using a calibration curve prepared in advance.

Even if the amount of P is less than 1.0 mg/m$^2$, it is possible to secure primary adhesion with the organic film, but it is not possible to secure secondary adhesion.

On the other hand, if the amount of deposition of phosphate exceeds 5.0 mg/m$^2$ in terms of P, cohesive failure of the phosphate easily occurs and both the primary adhesion and secondary adhesion with the organic film cannot be secured.

From the viewpoint of stably securing primary adhesion and secondary adhesion with the organic film, the amount of deposition of the phosphate is preferably 1.9 to 3.8 mg/m$^2$ in terms of P, more preferably 1.9 to 3.3 mg/m$^2$.

The phosphate preferably contains iron phosphate. Iron phosphate is formed on the alloy tin layer not covered with free tin and contributes to the improvement of the primary adhesion and secondary adhesion of the organic film.

The higher the area rate of the alloy tin layer not covered with free tin, the more the adhesion with organic film tends to be improved. If the coating weight of free tin is extremely small, the resistance to an acidic solution falls. This is because iron phosphate has a high solubility in an acidic solution.

Therefore, in case of using steel sheet having a phosphate film mainly comprised of iron phosphate covered with the organic film, as an acidic food container, acidic solution may enter from the defect part of the inner organic film to the steel sheet-organic film interface and the peeled part of the film may broaden.

Therefore, to secure resistance to an acidic solution, it is preferable that the phosphate include tin phosphate. The tin phosphate layer formed on the free tin has a high acid resistance and does not easily dissolve due to an acidic solution, so it inhibits the entry of an acidic solution to the steel sheet-organic film interface.

On the other hand, tin phosphate is also formed on the tin alloy layer, but it is present in a state mixed with the iron phosphate, so it is difficult to inhibit entry of an acidic solution.

To inhibit an acidic solution from entering a steel sheet-organic film interface, the area rate of the tin alloy layer covered with the free tin has to be 5 to 97%.

If the covered area rate is less than 5%, the area rate of the tin phosphate with the good acid resistance is low, so the effect of inhibiting entry of an acidic solution to the steel sheet-organic film interface is insufficient.

On the other hand, if the covered area rate is over 97%, the area rate of the iron phosphate becomes too low and adhesion with the organic film cannot be secured. From the viewpoint of stably securing both an effect of inhibition of entry of an acidic solution and adhesion of the organic film, the covered area rate of the tin alloy layer is preferably 20 to 85%.

The covered area rate of the metal tin on the tin alloy layer can be found by any of the measurement methods of the following (i) and (ii).

(i) Method Using SEM

If using an SEM (scanning electron microscope) to observe a tin-plated steel sheet, the tin appears white (bright) while the tin-iron alloy or iron surface appears black (dark), so computer image processing software is used to digitalize the image, detect the area of the white parts, and calculate the percentage to the whole.

The magnification of the SEM does not affect the measurement results, but 1000 to 2000× or so is preferably for digitalization. A magnification of 1000 to 2000× or so is used for measurement of about 10 fields and the average value is calculated.

However, the projecting parts forming the coarse surface at the iron surface appear white, so error occurs in the value measured by an SEM. In this sense, the method of using an SEM is not a strict measurement method, but is a convenient method, so usually this method is used.

(ii) Method Using EPMA

An EPMA (electron probe X-ray microanalysis) is used for area analysis of the tin of the sample surface. In the same way as the method of the above (i), a magnification of 1000 to 2000× or so is used to measure about 10 fields and the average value is calculated.

Since the characteristic X-ray intensity detected from the part of the free tin deposited on top of the tin-iron alloy layer, becomes higher than the characteristic X-ray intensity detected from the part of the tin-iron alloy layer, computer image processing software is used to digitalize this and calculate the area of the parts with the high characteristic X-ray intensity.

At the time of digitalization, it is difficult to determine the reference intensity for dividing the characteristic X-ray intensity into two, but for example the following technique may be used for determination of the reference intensity and digitalization.

If measuring the characteristic X-ray intensity of a sample where the free tin is detinned by constant potential electrolysis in advance in a 5% sodium hydroxide solution (where alloy layer is completely exposed), using the measured value as the characteristic X-ray intensity (reference value) of the alloy layer, and deeming the parts where a characteristic X-ray intensity of that intensity (reference value) or more as the parts where free tin is present, it is possible to calculate the covered area rate of the free tin.

The tin alloy forming the tin alloy layer may be any of an Fe—Sn alloy or Fe—Ni—Sn alloy. Further, it may be an alloy comprised of the two alloys mixed together.

In the case of an Fe—Sn alloy, almost all of it is $FeSn_2$. The amount of Sn is preferably 0.1 to 2.0 g/m$^2$. In tin-plated steel sheet produced by electrolytic tin-plating, then heat-melting the tin, at least 0.1 g/m$^2$ of tin alloy layer in terms of Sn is inevitably formed.

If the amount of Sn exceeds 2.0 g/m$^2$, in the processing such as bending or curling, micro-cracks serving as starting points of corrosion easily occur, so this is not preferable.

In the case of an Fe—Ni—Sn alloy, the amount of Ni is preferably 2 to 100 mg/m$^2$. The addition of Ni inhibits excessive formation of an alloy layer, but if less than 2 mg/m$^2$, the effect of addition is insufficient. On the other hand, Ni—Sn alloy over 100 mg/m$^2$ as Ni increases and the ratio of the iron in the alloy layer falls, so this is not preferred.

The coating weight of free tin is preferably 0.5 to 12 g/m$^2$. If less than 0.5 g/m$^2$, leaving an area rate of 5 to 97% of free tin after heat-melting of tin is difficult. On the other hand, if over 12 g/m$^2$, the steel sheet surface will be substantially covered with the free tin and the required exposed area rate of the tin alloy layer cannot be obtained.

Next, a method of production of tin-plated steel sheet for cans superior in secondary adhesion with an organic film will be explained.

The preplating operation of the steel sheet and the tin-plating bath used are not particularly prescribed in the present invention, but as preplating, if performing electrolytic alkaline cleaning and dilute sulfuric acid pickling, then performing electrolytic tin-plating in a phenolsulfonic acid bath, a sulfuric acid bath, or other acidic tin-plating bath containing a gloss agent, a good tin deposition can be obtained.

Before the electrolytic tin-plating, in accordance with need, electrolytic Fe—Ni alloy plating or electrolytic Ni plating may be applied to form a plating film of an amount of Ni of 2 to 100 mg/m$^2$.

For the Ni plating, it is also possible to plate the sheet, then heat it to make the Ni diffusion in the steel sheet surface layer and form an Fe—Ni alloy layer. After electrolytic tin-plating the tin-plated steel sheet is dipped in water or tin-plating solution diluted, dried, then heated for melting of tin.

The heat-melting is treatment heating the tin-plated steel sheet to above 232° C. or melting point of the tin. If the heating temperature exceeds 300° C., however, Fe—Sn alloying is excessively occurred, so this is not preferred.

As the heat-melting means, electrical resistance heating, induction heating, or combinations of these may be used. Right after the heat-melting, it is necessary to perform quenching and prevent the formation of an Fe—Sn alloy layer or Fe—Ni—Sn alloy layer or excessive formation of a tin oxide layer on the surface. The quenching is performed by dipping the steel strip in water.

If the tin-plated steel sheet is continuously melted and quenched, the water of the quench tank will rise to about 80° C., but the steel sheet heated up to need only to be cooled to the melting point of tin about 80° C.

After the quenching, the method explained below is used to chemically treat the tin-plated steel sheet.

The tin-plated steel sheet is treated by cathodic electrolysis in a phosphate solution of pH of 1.5 to 3.5 at 30 to 50° C. The cathodic current density is 2 to 30 A/dm$^2$ and the electrolysis time is 0.1 to 2 sec. Then an anodic electrolysis in the same phosphate solution is applied within 5 sec. after the cathodic electrolysis described above. The anodic current density is 0.2 to 5 A/dm$^2$ and the electrolysis time is 0.1 to 2 sec. Next, a cathodic electrolysis in a phosphate solution of pH of 1.5 to 3.5 at 30 to 50° C. The cathodic current density is 0.2 to 30 A/dm$^2$ and the electrolysis time is 0.1 to 2 sec.

The chemical species of the phosphate in a phosphate solution of pH 1.5 to 3.5 are mainly phosphoric acid and dihydrogenphosphate ion and a slight amount of hydrogenphosphate ion. The total phosphate concentration is preferably 20 to 50 g/L, more preferably 20 to 30 g/L, in terms of phosphoric acid concentration.

If the phosphate concentration is less than 20 g/L, the phosphate concentration near the steel sheet surface is too low to form a phosphate film. On the other hand, even if the phosphate concentration is over 30 g/L, there is almost no improvement in the performance. A phosphate concentration of over 50 g/L should be avoided because a precipitate should be formed.

To adjust the chemical species of phosphate and pH of the phosphate solution to the above-mentioned ranges, not only the hydrogen ion but also the other cations are required.

If a phosphate solution without adding a cation ingredient, pH should be lower than the above-mentioned range. As a result of this, a surplus phosphate film is formed, so the satisfactory dry and secondary adhesion with the organic film would not be obtained. Further, the tin-plated surface is etched by the treating solution and therefore the appearance becomes poor.

The suitable cations are soluble to an aqueous solution and can be removed easily from the steel sheet surface by rinsing after chemical treatment. As cations, one or more ions selected from sodium ions, potassium ions, calcium ions, magnesium ions, and ammonium ions are preferable.

The preferable cation concentration is determined from the ratio of phosphate concentration and hydrogen ion concentration. The cation concentration is 3 to 10 g/L in total.

The first cathodic electrolysis is mainly treatment for reducing the tin oxide or iron oxide formed at the surface of the tin-plated steel sheet by heat-melting. If a lot of tin oxide or iron oxide remains, the formation of a phosphate film by the next anodic electrolysis is obstructed.

If the cathodic current density is lower than 2 A/dm$^2$, it is not possible to sufficiently reduce the tin oxide or iron oxide formed by the heat-melting treatment. On the other hand, if the cathodic current density is higher than 30 A/dm$^2$, the amount of hydrogen gas generated at the cathode surface just becomes greater.

If the electrolysis time is shorter than 0.1 sec., the tin oxide and iron oxide cannot be sufficiently reduced. On the other hand, the tin oxide and iron oxide are sufficiently reduced in 2 sec., so even if the electrolysis time is made over 2 sec., not only the productivity reduced, but also the performance is not improved.

Anodic electrolysis is treatment oxidizing and dissolving the free tin and iron at the steel sheet surface, and combining the tin ion and iron ion with phosphate ion. Then a film consisting of tin phosphate and iron phosphate is formed on the tin-plated steel sheet surface. This treatment is performed within 5 sec. after the cathodic electrolysis. If leaving this for a time over 5 sec., the tin-plated steel sheet surface is reduced by cathodic electrolysis oxidizes again.

The anodic electrolysis performed after the cathodic electrolysis is preferably performed in the same solution in the same treatment cell. This is because it is possible to not expose the steel sheet after the cathodic electrolysis to the air and possible to effectively prevent the steel sheet surface from again oxidizing.

The current density in anodic electrolysis is preferably 0.2 to 5 A/dm$^2$ and the electrolysis time is preferably 0.1 to 2 sec. If the current density is less than 0.2 A/dm$^2$ or the electrolysis time is less than 0.1 sec., the speed of dissolution of the tin or iron is too slow to form the suitable phosphate film.

On the other hand, if the current density is over 5 A/dm$^2$, the speed of dissolution of tin or iron becomes too fast and the formed phosphate layer is sparse and brittle. If the electrolysis time exceeds 2 sec., the productivity falls and, further, the phosphate layer becomes thicker so conversely becomes brittler.

In the anodic electrolysis, as a secondary reaction, tin oxide is also produced. Excessive tin oxide obstructs the adhesion with the organic film, so to reduce the tin oxide, cathodic electrolysis is performed again. The electrolysis conditions are a current density of 1 to 30 A/dm$^2$ and an electrolysis time of 0.1 to 2 sec.

If the cathodic current density is lower than 1 A/dm$^2$, the tin oxide is insufficiently reduced. On the other hand, if the current density is higher than 30 A/dm$^2$, the amount of hydrogen gas generated at the cathode surface just becomes greater.

If the electrolysis time is shorter than 0.1 sec., the tin oxide is insufficiently reduced. On the other hand, if the electrolysis time exceeds 2 sec., the tin oxide becomes too small and conversely the adhesion with the organic film is damaged.

After the initial cathodic electrolysis, it is necessary to quickly perform the anodic electrolysis. If the covered object is once taken out from the treatment solution, the metal tin formed by reduction of the tin oxide on the surface by the cathodic electrolysis will again oxidize whereby a tin oxide layer will end up being formed and the coating adhesion will be degraded.

Due to restrictions in facilities, switching the polarity requires some time, but the time required for this switching is preferably short.

The anodic electrolysis and the final cathodic electrolysis do not have to be switched as fast as the initial cathodic electrolysis and the next anodic electrolysis are switched, but the time required for the switching is again preferably short.

The switching time from the first cathodic electrolysis to the anodic electrolysis is normally within 5 sec., preferably within 2 sec., more preferably within 1 sec., still more preferably within 0.5 sec.

On the other hand, the switching time from the anodic electrolysis to the final cathodic electrolysis is normally within 10 sec., preferably within 5 sec., more preferably within 3 sec., still more preferably within 2 sec.

EXAMPLES

Below, examples will be used to further explain the present invention.

Example 1

A low-carbon cold-rolled steel strip was continuously annealed, then temper rolled to obtain a 0.18 mm thick, T-5CA temper steel strip for use. As plating pretreatment, this was electrolytically degreased in a 10 mass % sodium hydroxide solution, then pickled by 5 mass % dilute sulfuric acid.

Part of the steel strip was given an Fe—Ni alloy plating or Ni plating. The steel strip given the Ni plating was then annealed to make the Ni diffusion and form an Fe—Ni alloy layer.

Next, a ferrostan bath was used to given an electrolytic tin plating. Cathodic electrolysis was performed in a 43° C. plating solution containing tin ions in 20 g/L, phenolsulfonic acid in 75 g/L, and a surfactant in 5 g/L at a current density of 20 A/dm$^2$. For the anode, platinum plated titanium was used. The amount of deposition of tin-plating was adjusted by the electrolysis time.

After the tin-plating, the strip was dipped in water or a tin-plating solution diluted 10 fold, squeezed of solution by rubber rolls, then dried by air, heated to 250° C. by conduction heating to make the tin melt, then immediately quenched with water at 70° C.

After this, the tin-plated steel sheet was chemically treated as follows:

The sheet was treated by cathodic electrolysis in a treating solution containing a total phosphate concentration of 35 g/L in terms of phosphoric acid and cations in 4 g/L and having a solution temperature of 40° C., then treated by anodic electrolysis in the same solution. After the cathodic-anodic electrolysis, the sheet was further treated by cathodic electrolysis in the solution which is consisting of the same composition and condition.

The amounts of deposition of P and Ni were determined by the fluorescent X-ray analysis using a calibration curve prepared in advance. The amount of deposition of Sn was determined by the electrostripper method in 1 mol/L dilute hydrochloric acid using a tin-plated steel sheet as an anode.

Note that the presence of P as tin phosphate and iron phosphate could be confirmed by analysis of the ratios of Sn, Fe, P, and O in a microarea by AES (Auger electron spectroscopy) and the state of bonding of Sn, Fe, P, and O by XPS (X-ray photoelectron spectroscopy).

The amount of tin oxide was found as the amount of electricity required for reduction from a potential-time curve obtained by cathodic electrolysis by a constant current of 0.05 $mA/cm^2$ in a 0.001 mol/L hydrobromic acid aqueous solution degassed by nitrogen gas.

The treated material was evaluated for the items of (A) to (D) shown below.

(A) Lacquer Dry Adhesion

A material for evaluation was coated with an epoxy-phenol-based lacquer to 60 $mg/dm^2$ and baked at 210° C. for 10 minutes. Further, this was additionally baked at 190° C. for 15 minutes and at 230° C. for 90 seconds.

From this coated sheet, a 5 mm×100 mm size sample was cut out. Two samples of the same level were set so that the coated surfaces faced each other with a film-shaped nylon adhesive of a thickness of 100 μm sandwiched between them.

This assembly was preheated, leaving grip parts, by a hot press at 200° C. for 60 sec., then given a pressure of $2.9\times10^5$ Pa and press bonded at 200° C. for 50 sec. to obtain a tensile test piece.

The grip parts were bent at angles of 90° to form a T-shape. These were gripped by the chucks of the tensile tester and pulled, then the peel strength was measured to evaluate the dry adhesion with the coating.

A measurement strength per 5 mm width of the test piece of 68 N or more was evaluated as "VG" (very good), one of 49 N to less than 68 N was evaluated as "G" (good), one of 29 N to less than 49 N as "F" (fair), and one of less than 29 N as "P" (poor).

(B) Secondary Adhesion with Coating

A material for evaluation was coated, baked, and pressed with another via a nylon adhesive to prepare a test piece in the same procedure as in (A).

This was retort processed at 125° C. for 30 minutes, then right after the grip parts were bent at angles of 90° to form a T-shape. These were gripped by the chucks of the tensile tester and pulled, then the peel strength was measured to evaluate the secondary adhesion with the coating.

A measurement strength per 5 mm width of the test piece of 42 N or more was evaluated as "VG" (very good), one of 34 N to less than 42 N was evaluated as "G" (good), one of 25 N to less than 34 N as "F" (fair), and one of less than 25 N as "P" (poor).

(C) Corrosion Resistance

To evaluate the corrosion resistance of the surface of an evaluated material corresponding to the inside surface of a can in an acidic solution including chloride ions, an UCC (undercutting corrosion) test was performed.

A sheet was coated with an epoxy-phenol-based coating to 50 $mg/dm^2$ which was baked on at 205° C. for 10 minutes. Further, this was additionally baked at 180° C. for 10 minutes. From this coated sheet, a 50 mm×50 mm size sample was cut out.

The film was cross-cut by a cutter to reduce the base iron, the end faces and back surface were sealed by a coating, then the sample was dipped in a 55° C. test solution comprising 1.5% citric acid and 1.5% sodium chloride open to the air for 96 hours.

The sample was rinsed and dried, then quickly the cross-cut part and planar part were peeled off by tape, the state of corrosion near the cross-cut part, pitting corrosion of the cross-cut part, and the state of peeling of the film at the planar part were examined, whereby the corrosion resistance was evaluated.

Samples where no removal of the lacquer film by the tape and no corrosion could be observed were evaluated as "VG" (very good), samples where one or both of removal of the lacquer film of less than 0.2 mm from the cross-cut part or not visually observable slight corrosion could be observed were evaluated as "G" (good), samples where one or both of removal of the lacquer film of 0.2 mm to 0.5 mm from the cross-cut part or visually observable small corrosion could be observed were evaluated as "F" (fair), and samples where removal of the lacquer film of over 0.5 mm occurred were evaluated as P (poor).

(D) Appearance

The appearance of the materials chemically treated was evaluated visually by the gloss, color, and evenness. Examples with a very good appearance were judged to be "VG" (very good), examples with a good appearance not a problem in the product were judged to be "G" (good), examples with points fair in appearance as products were judged to be "F" (fair), and examples poor in appearance and not suitable as products were judged as "P" (poor).

From the above results of evaluation of performance, the examples were evaluated as four stages of "VG" (very good), "G" (good), "F" (fair), and "P" (poor). "VG" and "G" were deemed passing levels.

The test conditions, including not described test conditions, are shown in Table 1, Table 2, Table 3, and Table 4, while the results of evaluation are shown in Table 5, Table 6, Table 7, and Table 8.

TABLE 1

| | | | | Electrolysis conditions in phosphate solution | | | | | |
|---|---|---|---|---|---|---|---|---|---|
| | | | | Cathodic electrolysis | | Anodic electrolysis | | Cathodic electrolysis | |
| | Inner plating | pH | Cations | Current density | Electrolysis time | Current density | Electrolysis time | Current density | Electrolysis time |
| Ex. 1 | None | 2.5 | $Na^+$ | 10 $A/dm^2$ | 0.4 sec. | 1 $A/dm^2$ | 0.4 sec. | 10 $A/dm^2$ | 0.4 sec. |
| Ex. 2 | None | 2.5 | $Na^+$ | 10 $A/dm^2$ | 0.4 sec. | 1 $A/dm^2$ | 0.4 sec. | 10 $A/dm^2$ | 0.4 sec. |
| Ex. 3 | None | 2.5 | $Na^+$ | 10 $A/dm^2$ | 0.4 sec. | 1 $A/dm^2$ | 0.4 sec. | 10 $A/dm^2$ | 0.4 sec. |
| Ex. 4 | None | 2.5 | $Na^+$ | 10 $A/dm^2$ | 0.4 sec. | 1 $A/dm^2$ | 0.4 sec. | 10 $A/dm^2$ | 0.4 sec. |
| Ex. 5 | None | 2.5 | $Na^+$ | 10 $A/dm^2$ | 0.4 sec. | 1 $A/dm^2$ | 0.4 sec. | 10 $A/dm^2$ | 0.4 sec. |
| Ex. 6 | None | 2.5 | $Na^+$ | 10 $A/dm^2$ | 0.4 sec. | 1 $A/dm^2$ | 0.4 sec. | 10 $A/dm^2$ | 0.4 sec. |
| Ex. 7 | None | 2.5 | $Na^+$ | 10 $A/dm^2$ | 0.4 sec. | 1 $A/dm^2$ | 0.4 sec. | 10 $A/dm^2$ | 0.4 sec. |
| Ex. 8 | None | 2.5 | $Na^+$ | 10 $A/dm^2$ | 0.4 sec. | 1 $A/dm^2$ | 0.4 sec. | 10 $A/dm^2$ | 0.4 sec. |
| Ex. 9 | None | 2.5 | $Na^+$ | 10 $A/dm^2$ | 0.4 sec. | 1 $A/dm^2$ | 0.4 sec. | 10 $A/dm^2$ | 0.4 sec. |
| Ex. 10 | None | 2.5 | $Na^+$ | 10 $A/dm^2$ | 0.4 sec. | 1 $A/dm^2$ | 0.4 sec. | 10 $A/dm^2$ | 0.4 sec. |
| Ex. 11 | None | 2.5 | $Na^+$ | 10 $A/dm^2$ | 0.4 sec. | 1 $A/dm^2$ | 0.4 sec. | 10 $A/dm^2$ | 0.4 sec. |
| Ex. 12 | None | 2.5 | $Na^+$ | 10 $A/dm^2$ | 0.4 sec. | 1 $A/dm^2$ | 0.4 sec. | 10 $A/dm^2$ | 0.4 sec. |

TABLE 1-continued

| | | | Electrolysis conditions in phosphate solution | | | | | |
|---|---|---|---|---|---|---|---|---|
| | | | Cathodic electrolysis | | Anodic electrolysis | | Cathodic electrolysis | |
| | Inner plating | pH Cations | Current density | Electrolysis time | Current density | Electrolysis time | Current density | Electrolysis time |
| Ex. 13 | None | 2.5 $Na^+$ | 10 $A/dm^2$ | 0.4 sec. | 1 $A/dm^2$ | 0.4 sec. | 10 $A/dm^2$ | 0.4 sec. |
| Ex. 14 | None | 2.5 $Na^+$ | 10 $A/dm^2$ | 0.4 sec. | 1 $A/dm^2$ | 0.4 sec. | 10 $A/dm^2$ | 0.4 sec. |
| Ex. 15 | None | 2.5 $Na^+$ | 10 $A/dm^2$ | 0.4 sec. | 1 $A/dm^2$ | 0.4 sec. | 10 $A/dm^2$ | 0.4 sec. |
| Ex. 16 | None | 2.5 $Na^+$ | 2 $A/dm^2$ | 0.4 sec. | 1 $A/dm^2$ | 0.4 sec. | 1 $A/dm^2$ | 0.4 sec. |
| Ex. 17 | None | 2.5 $Na^+$ | 2 $A/dm^2$ | 0.4 sec. | 1 $A/dm^2$ | 0.4 sec. | 2 $A/dm^2$ | 0.4 sec. |
| Ex. 18 | None | 2.5 $Na^+$ | 2 $A/dm^2$ | 0.4 sec. | 1 $A/dm^2$ | 0.4 sec. | 5 $A/dm^2$ | 0.4 sec. |
| Ex. 19 | None | 2.5 $Na^+$ | 2 $A/dm^2$ | 0.4 sec. | 1 $A/dm^2$ | 0.4 sec. | 10 $A/dm^2$ | 0.4 sec. |
| Ex. 20 | None | 2.5 $Na^+$ | 2 $A/dm^2$ | 0.4 sec. | 1 $A/dm^2$ | 0.4 sec. | 18 $A/dm^2$ | 0.4 sec. |
| Ex. 21 | None | 2.5 $Na^+$ | 2 $A/dm^2$ | 0.4 sec. | 1 $A/dm^2$ | 0.4 sec. | 28 $A/dm^2$ | 0.4 sec. |
| Ex. 22 | None | 2.5 $Na^+$ | 5 $A/dm^2$ | 0.4 sec. | 0.5 $A/dm^2$ | 0.4 sec. | 5 $A/dm^2$ | 0.4 sec. |
| Ex. 23 | None | 2.5 $Na^+$ | 5 $A/dm^2$ | 0.4 sec. | 0.5 $A/dm^2$ | 0.4 sec. | 10 $A/dm^2$ | 0.4 sec. |
| Ex. 24 | None | 2.5 $Na^+$ | 5 $A/dm^2$ | 0.4 sec. | 0.5 $A/dm^2$ | 0.4 sec. | 18 $A/dm^2$ | 0.4 sec. |
| Ex. 25 | None | 2.5 $Na^+$ | 5 $A/dm^2$ | 0.4 sec. | 0.5 $A/dm^2$ | 0.4 sec. | 28 $A/dm^2$ | 0.4 sec. |
| Ex. 26 | None | 2.5 $Na^+$ | 5 $A/dm^2$ | 0.4 sec. | 1 $A/dm^2$ | 0.4 sec. | 1 $A/dm^2$ | 0.4 sec. |
| Ex. 27 | None | 2.5 $Na^+$ | 5 $A/dm^2$ | 0.4 sec. | 1 $A/dm^2$ | 0.4 sec. | 2 $A/dm^2$ | 0.4 sec. |
| Ex. 28 | None | 2.5 $Na^+$ | 5 $A/dm^2$ | 0.4 sec. | 1 $A/dm^2$ | 0.4 sec. | 5 $A/dm^2$ | 0.4 sec. |
| Ex. 29 | None | 2.5 $Na^+$ | 5 $A/dm^2$ | 0.4 sec. | 1 $A/dm^2$ | 0.4 sec. | 10 $A/dm^2$ | 0.4 sec. |
| Ex. 30 | None | 2.5 $Na^+$ | 5 $A/dm^2$ | 0.4 sec. | 1 $A/dm^2$ | 0.4 sec. | 18 $A/dm^2$ | 0.4 sec. |
| Ex. 31 | None | 2.5 $Na^+$ | 5 $A/dm^2$ | 0.4 sec. | 1 $A/dm^2$ | 0.4 sec. | 28 $A/dm^2$ | 0.4 sec. |
| Ex. 32 | None | 2.5 $Na^+$ | 10 $A/dm^2$ | 0.15 sec. | 1 $A/dm^2$ | 0.4 sec. | 10 $A/dm^2$ | 0.4 sec. |
| Ex. 33 | None | 2.5 $Na^+$ | 10 $A/dm^2$ | 2.0 sec. | 1 $A/dm^2$ | 0.4 sec. | 10 $A/dm^2$ | 0.4 sec. |
| Ex. 34 | None | 2.5 $Na^+$ | 10 $A/dm^2$ | 0.4 sec. | 0.25 $A/dm^2$ | 0.15 sec. | 10 $A/dm^2$ | 0.4 sec. |
| Ex. 35 | None | 2.5 $Na^+$ | 10 $A/dm^2$ | 0.4 sec. | 0.25 $A/dm^2$ | 0.25 sec. | 10 $A/dm^2$ | 0.4 sec. |

TABLE 2

| | | | Electrolysis conditions in phosphate solution | | | | | |
|---|---|---|---|---|---|---|---|---|
| | | | Cathodic electrolysis | | Anodic electrolysis | | Cathodic electrolysis | |
| | Inner plating | pH Cations | Current density | Electrolysis time | Current density | Electrolysis time | Current density | Electrolysis time |
| Ex. 36 | None | 2.5 $Na^+$ | 10 $A/dm^2$ | 0.4 sec. | 0.25 $A/dm^2$ | 0.4 sec. | 10 $A/dm^2$ | 0.4 sec. |
| Ex. 37 | None | 2.5 $Na^+$ | 10 $A/dm^2$ | 0.4 sec. | 0.25 $A/dm^2$ | 1 sec. | 10 $A/dm^2$ | 0.4 sec. |
| Ex. 38 | None | 2.5 $Na^+$ | 10 $A/dm^2$ | 0.4 sec. | 0.25 $A/dm^2$ | 1.9 sec. | 10 $A/dm^2$ | 0.4 sec. |
| Ex. 39 | None | 2.5 $Na^+$ | 10 $A/dm^2$ | 0.4 sec. | 0.5 $A/dm^2$ | 0.15 sec. | 10 $A/dm^2$ | 0.4 sec. |
| Ex. 40 | None | 2.5 $Na^+$ | 10 $A/dm^2$ | 0.4 sec. | 0.5 $A/dm^2$ | 0.25 sec. | 10 $A/dm^2$ | 0.4 sec. |
| Ex. 41 | None | 2.5 $Na^+$ | 10 $A/dm^2$ | 0.4 sec. | 0.5 $A/dm^2$ | 0.4 sec. | 10 $A/dm^2$ | 0.4 sec. |
| Ex. 42 | None | 2.5 $Na^+$ | 10 $A/dm^2$ | 0.4 sec. | 0.5 $A/dm^2$ | 1 sec. | 10 $A/dm^2$ | 0.4 sec. |
| Ex. 43 | None | 2.5 $Na^+$ | 10 $A/dm^2$ | 0.4 sec. | 0.5 $A/dm^2$ | 1.9 sec. | 10 $A/dm^2$ | 0.4 sec. |
| Ex. 44 | None | 2.5 $Na^+$ | 10 $A/dm^2$ | 0.4 sec. | 0.5 $A/dm^2$ | 0.4 sec. | 5 $A/dm^2$ | 0.4 sec. |
| Ex. 45 | None | 2.5 $Na^+$ | 10 $A/dm^2$ | 0.4 sec. | 0.5 $A/dm^2$ | 0.4 sec. | 18 $A/dm^2$ | 0.4 sec. |
| Ex. 46 | None | 2.5 $Na^+$ | 10 $A/dm^2$ | 0.4 sec. | 0.5 $A/dm^2$ | 0.4 sec. | 28 $A/dm^2$ | 0.4 sec. |
| Ex. 47 | None | 2.5 $Na^+$ | 10 $A/dm^2$ | 0.4 sec. | 0.7 $A/dm^2$ | 0.15 sec. | 10 $A/dm^2$ | 0.4 sec. |
| Ex. 48 | None | 2.5 $Na^+$ | 10 $A/dm^2$ | 0.4 sec. | 0.7 $A/dm^2$ | 0.25 sec. | 10 $A/dm^2$ | 0.4 sec. |
| Ex. 49 | None | 2.5 $Na^+$ | 10 $A/dm^2$ | 0.4 sec. | 0.7 $A/dm^2$ | 0.4 sec. | 10 $A/dm^2$ | 0.4 sec. |
| Ex. 50 | None | 2.5 $Na^+$ | 10 $A/dm^2$ | 0.4 sec. | 0.7 $A/dm^2$ | 1 sec. | 10 $A/dm^2$ | 0.4 sec. |
| Ex. 51 | None | 2.5 $Na^+$ | 10 $A/dm^2$ | 0.4 sec. | 0.7 $A/dm^2$ | 1.9 sec. | 10 $A/dm^2$ | 0.4 sec. |
| Ex. 52 | None | 2.5 $Na^+$ | 10 $A/dm^2$ | 0.4 sec. | 1 $A/dm^2$ | 0.15 sec. | 10 $A/dm^2$ | 0.4 sec. |
| Ex. 53 | None | 2.5 $Na^+$ | 10 $A/dm^2$ | 0.4 sec. | 1 $A/dm^2$ | 0.25 sec. | 10 $A/dm^2$ | 0.4 sec. |
| Ex. 54 | None | 2.5 $Na^+$ | 10 $A/dm^2$ | 0.4 sec. | 1 $A/dm^2$ | 1 sec. | 10 $A/dm^2$ | 0.4 sec. |
| Ex. 55 | None | 2.5 $Na^+$ | 10 $A/dm^2$ | 0.4 sec. | 1 $A/dm^2$ | 1.9 sec. | 10 $A/dm^2$ | 0.4 sec. |
| Ex. 56 | None | 2.5 $Na^+$ | 10 $A/dm^2$ | 0.4 sec. | 1 $A/dm^2$ | 0.4 sec. | 1 $A/dm^2$ | 0.4 sec. |
| Ex. 57 | None | 2.5 $Na^+$ | 10 $A/dm^2$ | 0.4 sec. | 1 $A/dm^2$ | 0.4 sec. | 2 $A/dm^2$ | 0.4 sec. |
| Ex. 58 | None | 2.5 $Na^+$ | 10 $A/dm^2$ | 0.4 sec. | 1 $A/dm^2$ | 0.4 sec. | 5 $A/dm^2$ | 0.4 sec. |
| Ex. 59 | None | 2.5 $Na^+$ | 10 $A/dm^2$ | 0.4 sec. | 1 $A/dm^2$ | 0.4 sec. | 18 $A/dm^2$ | 0.4 sec. |
| Ex. 60 | None | 2.5 $Na^+$ | 10 $A/dm^2$ | 0.4 sec. | 1 $A/dm^2$ | 0.4 sec. | 28 $A/dm^2$ | 0.4 sec. |
| Ex. 61 | None | 2.5 $Na^+$ | 10 $A/dm^2$ | 0.4 sec. | 1 $A/dm^2$ | 0.4 sec. | 10 $A/dm^2$ | 0.15 sec. |
| Ex. 62 | None | 2.5 $Na^+$ | 10 $A/dm^2$ | 0.4 sec. | 1 $A/dm^2$ | 0.4 sec. | 10 $A/dm^2$ | 1.9 sec. |
| Ex. 63 | None | 2.5 $Na^+$ | 10 $A/dm^2$ | 0.4 sec. | 2 $A/dm^2$ | 0.15 sec. | 10 $A/dm^2$ | 0.4 sec. |
| Ex. 64 | None | 2.5 $Na^+$ | 10 $A/dm^2$ | 0.4 sec. | 2 $A/dm^2$ | 0.25 sec. | 10 $A/dm^2$ | 0.4 sec. |
| Ex. 65 | None | 2.5 $Na^+$ | 10 $A/dm^2$ | 0.4 sec. | 2 $A/dm^2$ | 0.4 sec. | 10 $A/dm^2$ | 0.4 sec. |
| Ex. 66 | None | 2.5 $Na^+$ | 10 $A/dm^2$ | 0.4 sec. | 2 $A/dm^2$ | 1 sec. | 10 $A/dm^2$ | 0.4 sec. |
| Ex. 67 | None | 2.5 $Na^+$ | 10 $A/dm^2$ | 0.4 sec. | 2 $A/dm^2$ | 1.9 sec. | 10 $A/dm^2$ | 0.4 sec. |
| Ex. 68 | None | 2.5 $Na^+$ | 10 $A/dm^2$ | 0.4 sec. | 5 $A/dm^2$ | 0.15 sec. | 10 $A/dm^2$ | 0.4 sec. |
| Ex. 69 | None | 2.5 $Na^+$ | 10 $A/dm^2$ | 0.4 sec. | 5 $A/dm^2$ | 0.25 sec. | 10 $A/dm^2$ | 0.4 sec. |
| Ex. 70 | None | 2.5 $Na^+$ | 10 $A/dm^2$ | 0.4 sec. | 5 $A/dm^2$ | 0.4 sec. | 10 $A/dm^2$ | 0.4 sec. |

TABLE 3

| | | | Electrolysis conditions in phosphate solution | | | | | |
|---|---|---|---|---|---|---|---|---|
| | | | Cathodic electrolysis | | Anodic electrolysis | | Cathodic electrolysis | |
| | Inner plating | pH Cations | Current density | Electrolysis time | Current density | Electrolysis time | Current density | Electrolysis time |
| Ex. 71 | None | 2.5 $Na^+$ | 10 $A/dm^2$ | 0.4 sec. | 5 $A/dm^2$ | 1 sec. | 10 $A/dm^2$ | 0.4 sec. |
| Ex. 72 | None | 2.5 $Na^+$ | 10 $A/dm^2$ | 0.4 sec. | 5 $A/dm^2$ | 1.9 sec. | 10 $A/dm^2$ | 0.4 sec. |
| Ex. 73 | None | 2.5 $Na^+$ | 18 $A/dm^2$ | 0.4 sec. | 0.5 $A/dm^2$ | 0.4 sec. | 5 $A/dm^2$ | 0.4 sec. |
| Ex. 74 | None | 2.5 $Na^+$ | 18 $A/dm^2$ | 0.4 sec. | 0.5 $A/dm^2$ | 0.4 sec. | 10 $A/dm^2$ | 0.4 sec. |
| Ex. 75 | None | 2.5 $Na^+$ | 18 $A/dm^2$ | 0.4 sec. | 0.5 $A/dm^2$ | 0.4 sec. | 18 $A/dm^2$ | 0.4 sec. |
| Ex. 76 | None | 2.5 $Na^+$ | 18 $A/dm^2$ | 0.4 sec. | 0.5 $A/dm^2$ | 0.4 sec. | 28 $A/dm^2$ | 0.4 sec. |
| Ex. 77 | None | 2.5 $Na^+$ | 18 $A/dm^2$ | 0.4 sec. | 1 $A/dm^2$ | 0.4 sec. | 1 $A/dm^2$ | 0.4 sec. |
| Ex. 78 | None | 2.5 $Na^+$ | 18 $A/dm^2$ | 0.4 sec. | 1 $A/dm^2$ | 0.4 sec. | 2 $A/dm^2$ | 0.4 sec. |
| Ex. 79 | None | 2.5 $Na^+$ | 18 $A/dm^2$ | 0.4 sec. | 1 $A/dm^2$ | 0.4 sec. | 5 $A/dm^2$ | 0.4 sec. |
| Ex. 80 | None | 2.5 $Na^+$ | 18 $A/dm^2$ | 0.4 sec. | 1 $A/dm^2$ | 0.4 sec. | 10 $A/dm^2$ | 0.4 sec. |
| Ex. 81 | None | 2.5 $Na^+$ | 18 $A/dm^2$ | 0.4 sec. | 1 $A/dm^2$ | 0.4 sec. | 18 $A/dm^2$ | 0.4 sec. |
| Ex: 82 | None | 2.5 $Na^+$ | 18 $A/dm^2$ | 0.4 sec. | 1 $A/dm^2$ | 0.4 sec. | 28 $A/dm^2$ | 0.4 sec. |
| Ex. 83 | None | 2.5 $Na^+$ | 28 $A/dm^2$ | 0.4 sec. | 0.5 $A/dm^2$ | 0.4 sec. | 5 $A/dm^2$ | 0.4 sec. |
| Ex. 84 | None | 2.5 $Na^+$ | 28 $A/dm^2$ | 0.4 sec. | 0.5 $A/dm^2$ | 0.4 sec. | 10 $A/dm^2$ | 0.4 sec. |
| Ex. 85 | None | 2.5 $Na^+$ | 28 $A/dm^2$ | 0.4 sec. | 0.5 $A/dm^2$ | 0.4 sec. | 18 $A/dm^2$ | 0.4 sec. |
| Ex. 86 | None | 2.5 $Na^+$ | 28 $A/dm^2$ | 0.4 sec. | 0.5 $A/dm^2$ | 0.4 sec. | 28 $A/dm^2$ | 0.4 sec. |
| Ex. 87 | None | 2.5 $Na^+$ | 28 $A/dm^2$ | 0.4 sec. | 1 $A/dm^2$ | 0.4 sec. | 1 $A/dm^2$ | 0.4 sec. |
| Ex. 88 | None | 2.5 $Na^+$ | 28 $A/dm^2$ | 0.4 sec. | 1 $A/dm^2$ | 0.4 sec. | 2 $A/dm^2$ | 0.4 sec. |
| Ex. 89 | None | 2.5 $Na^+$ | 28 $A/dm^2$ | 0.4 sec. | 1 $A/dm^2$ | 0.4 sec. | 5 $A/dm^2$ | 0.4 sec. |
| Ex. 90 | None | 2.5 $Na^+$ | 28 $A/dm^2$ | 0.4 sec. | 1 $A/dm^2$ | 0.4 sec. | 10 $A/dm^2$ | 0.4 sec. |
| Ex. 91 | None | 2.5 $Na^+$ | 28 $A/dm^2$ | 0.4 sec. | 1 $A/dm^2$ | 0.4 sec. | 18 $A/dm^2$ | 0.4 sec. |
| Ex. 92 | None | 2.5 $Na^+$ | 28 $A/dm^2$ | 0.4 sec. | 1 $A/dm^2$ | 0.4 sec. | 28 $A/dm^2$ | 0.4 sec. |
| Ex. 93 | None | 1.6 $Na^+$ | 10 $A/dm^2$ | 0.4 sec. | 1 $A/dm^2$ | 0.4 sec. | 10 $A/dm^2$ | 0.4 sec. |
| Ex. 94 | None | 3.3 $Na^+$ | 10 $A/dm^2$ | 0.4 sec. | 1 $A/dm^2$ | 0.4 sec. | 10 $A/dm^2$ | 0.4 sec. |
| Ex. 95 | None | 2.5 $K^+$ | 10 $A/dm^2$ | 0.4 sec. | 1 $A/dm^2$ | 0.4 sec. | 10 $A/dm^2$ | 0.4 sec. |
| Ex. 96 | None | 2.5 $Ca^{2+}$ | 10 $A/dm^2$ | 0.4 sec. | 1 $A/dm^2$ | 0.4 sec. | 10 $A/dm^2$ | 0.4 sec. |
| Ex. 97 | None | 2.5 $Mg^{2+}$ | 10 $A/dm^2$ | 0.4 sec. | 1 $A/dm^2$ | 0.4 sec. | 10 $A/dm^2$ | 0.4 sec. |
| Ex. 98 | None | 2.5 $NH_4^+$ | 10 $A/dm^2$ | 0.4 sec. | 1 $A/dm^2$ | 0.4 sec. | 10 $A/dm^2$ | 0.4 sec. |
| Ex. 99 | Ni | 2.5 $Na^+$ | 10 $A/dm^2$ | 0.4 sec. | 1 $A/dm^2$ | 0.4 sec. | 10 $A/dm^2$ | 0.4 sec. |
| Ex. 100 | Ni | 2.5 $Na^+$ | 10 $A/dm^2$ | 0.4 sec. | 1 $A/dm^2$ | 0.4 sec. | 10 $A/dm^2$ | 0.4 sec. |
| Ex. 101 | Ni | 2.5 $Na^+$ | 10 $A/dm^2$ | 0.4 sec. | 1 $A/dm^2$ | 0.4 sec. | 10 $A/dm^2$ | 0.4 sec. |
| Ex. 102 | Fe—Ni | 2.5 $Na^+$ | 10 $A/dm^2$ | 0.4 sec. | 1 $A/dm^2$ | 0.4 sec. | 10 $A/dm^2$ | 0.4 sec. |
| Ex. 103 | Fe—Ni | 2.5 $Na^+$ | 10 $A/dm^2$ | 0.4 sec. | 1 $A/dm^2$ | 0.4 sec. | 10 $A/dm^2$ | 0.4 sec. |
| Ex. 104 | Fe—Ni | 2.5 $Na^+$ | 10 $A/dm^2$ | 0.4 sec. | 1 $A/dm^2$ | 0.4 sec. | 10 $A/dm^2$ | 0.4 sec. |

TABLE 4

| | | | Electrolysis conditions in phosphate solution | | | | | |
|---|---|---|---|---|---|---|---|---|
| | | | Cathodic electrolysis | | Anodic electrolysis | | Cathodic electrolysis | |
| | Inner plating | pH Cations | Current density | Electrolysis time | Current density | Electrolysis time | Current density | Electrolysis time |
| Comp. Ex. 1 | None | 2.5 $Na^+$ | 10 $A/dm^2$ | 0.4 sec. | 1 $A/dm^2$ | 0.4 sec. | None | None |
| Comp. Ex. 2 | None | 2.5 $Na^+$ | 10 $A/dm^2$ | 0.4 sec. | None | None | None | None |
| Comp. Ex. 3 | None | — — | None | None | None | None | None | None |
| Comp. Ex. 4 | None | 2.5 $Na^+$ | 10 $A/dm^2$ | 0.4 sec. | 1 $A/dm^2$ | 0.4 sec. | 0.5 $A/dm^2$ | 0.05 sec. |
| Comp. Ex. 5 | None | 2.5 $Na^+$ | 10 $A/dm^2$ | 0.4 sec. | 1 $A/dm^2$ | 0.4 sec. | 40 $A/dm^2$ | 3 sec. |
| Comp. Ex. 6 | None | 2.5 $Na^+$ | 1 $A/dm^2$ | 0.05 sec. | 1 $A/dm^2$ | 0.4 sec. | 10 $A/dm^2$ | 0.4 sec. |
| Comp. Ex. 7 | None | 2.5 $Na^+$ | 10 $A/dm^2$ | 0.4 sec. | 0.1 $A/dm^2$ | 0.05 sec. | 10 $A/dm^2$ | 0.4 sec. |
| Comp. Ex. 8 | None | 2.5 $Na^+$ | 10 $A/dm^2$ | 0.4 sec. | 10 $A/dm^2$ | 0.4 sec. | 10 $A/dm^2$ | 0.4 sec. |
| Comp. Ex. 9 | None | 1.2 $Na^+$ | 10 $A/dm^2$ | 0.4 sec. | 1 $A/dm^2$ | 0.4 sec. | 10 $A/dm^2$ | 0.4 sec. |
| Comp. Ex. 10 | None | 4.1 $Na^+$ | 10 $A/dm^2$ | 0.4 sec. | 1 $A/dm^2$ | 0.4 sec. | 10 $A/dm^2$ | 0.4 sec. |
| Comp. Ex. 11 | None | 2.5 $Na^+$ | 10 $A/dm^2$ | 0.4 sec. | 1 $A/dm^2$ | 0.4 sec. | 10 $A/dm^2$ | 0.4 sec. |
| Comp. Ex. 12 | None | 2.5 $Na^+$ | 10 $A/dm^2$ | 0.4 sec. | 1 $A/dm^2$ | 0.4 sec. | 10 $A/dm^2$ | 0.4 sec. |
| Comp. Ex. 13 | None | 1.3 None | 10 $A/dm^2$ | 0.4 sec. | 1 $A/dm^2$ | 0.4 sec. | 10 $A/dm^2$ | 0.4 sec. |

TABLE 5

| | Free tin area rate % | Deposition Ni mg/m$^2$ | Free Sn g/m$^2$ | Alloy Sn g/m$^2$ | P mg/m$^2$ | Tin oxide mC/cm$^2$ | Tin phos-phate | Iron phos-phate | (A) Dry adhesion | (B) Secondary adhesion | (C) Corrosion resistance | (D) Appear-ance | Overall eval. |
|---|---|---|---|---|---|---|---|---|---|---|---|---|---|
| Ex. 1 | 5 | 0 | 0.6 | 0.2 | 2.3 | 2.5 | Yes | Yes | VG | VG | G | G | G |
| Ex. 2 | 6 | 0 | 0.56 | 0.3 | 2.2 | 2.3 | Yes | Yes | VG | VG | G | G | G |
| Ex. 3 | 8 | 0 | 0.6 | 0.1 | 2.4 | 2.5 | Yes | Yes | VG | VG | VG | G | G |
| Ex. 4 | 12 | 0 | 1.1 | 0.7 | 2.4 | 2.3 | Yes | Yes | VG | VG | G | VG | G |
| Ex. 5 | 28 | 0 | 1.1 | 0.4 | 2.3 | 2.4 | Yes | Yes | VG | VG | VG | VG | VG |
| Ex. 6 | 41 | 0 | 1.1 | 0.4 | 2.3 | 2.4 | Yes | Yes | VG | VG | VG | VG | VG |
| Ex. 7 | 55 | 0 | 1.1 | 0.2 | 2.5 | 2.4 | Yes | Yes | VG | VG | VG | VG | VG |
| Ex. 8 | 58 | 0 | 2.8 | 1.4 | 2.4 | 2.5 | Yes | Yes | VG | VG | VG | VG | VG |
| Ex. 9 | 72 | 0 | 2.8 | 1.0 | 2.4 | 2.5 | Yes | Yes | VG | VG | VG | VG | VG |
| Ex. 10 | 82 | 0 | 5.6 | 1.2 | 2.2 | 2.3 | Yes | Yes | VG | VG | VG | VG | VG |
| Ex. 11 | 82 | 0 | 2.8 | 0.6 | 2.4 | 2.5 | Yes | Yes | VG | VG | VG | VG | VG |
| Ex. 12 | 89 | 0 | 8.4 | 1.3 | 2.3 | 2.5 | Yes | Yes | VG | G | VG | VG | G |
| Ex. 13 | 93 | 0 | 10.0 | 1.3 | 2.3 | 2.5 | Yes | Yes | G | G | VG | VG | G |
| Ex. 14 | 96 | 0 | 11.2 | 2.0 | 2.4 | 2.6 | Yes | Yes | G | G | VG | VG | G |
| Ex. 15 | 97 | 0 | 12.0 | 1.9 | 2.4 | 2.6 | Yes | Yes | G | G | VG | VG | G |
| Ex. 16 | 72 | 0 | 2.8 | 1.0 | 2.4 | 3.9 | Yes | Yes | G | G | G | VG | G |
| Ex. 17 | 72 | 0 | 2.8 | 1.1 | 2.4 | 3.8 | Yes | Yes | G | G | G | VG | G |
| Ex. 18 | 72 | 0 | 2.9 | 1.1 | 2.4 | 3.3 | Yes | Yes | VG | G | VG | VG | G |
| Ex. 19 | 72 | 0 | 2.8 | 1.1 | 2.4 | 2.9 | Yes | Yes | VG | VG | VG | VG | VG |
| Ex. 20 | 72 | 0 | 2.8 | 1.1 | 2.4 | 2.3 | Yes | Yes | VG | VG | VG | VG | VG |
| Ex. 21 | 72 | 0 | 2.8 | 1.1 | 2.4 | 1.7 | Yes | Yes | VG | VG | VG | VG | VG |
| Ex. 22 | 71 | 0 | 2.8 | 1.0 | 2.1 | 3.2 | Yes | Yes | VG | G | VG | VG | G |
| Ex. 23 | 72 | 0 | 2.9 | 1.0 | 2.1 | 2.6 | Yes | Yes | VG | VG | VG | VG | VG |
| Ex. 24 | 72 | 0 | 2.8 | 1.0 | 2.1 | 1.9 | Yes | Yes | VG | VG | VG | VG | VG |
| Ex. 25 | 72 | 0 | 2.8 | 1.0 | 2.1 | 1.4 | Yes | Yes | VG | VG | VG | VG | VG |
| Ex. 26 | 72 | 0 | 2.8 | 1.1 | 2.4 | 3.7 | Yes | Yes | G | G | G | VG | G |
| Ex. 27 | 72 | 0 | 2.8 | 1.1 | 2.4 | 3.8 | Yes | Yes | G | G | G | VG | G |
| Ex. 28 | 72 | 0 | 2.8 | 1.1 | 2.4 | 3.1 | Yes | Yes | VG | G | VG | VG | G |
| Ex. 29 | 71 | 0 | 2.8 | 1.1 | 2.3 | 2.6 | Yes | Yes | VG | VG | VG | VG | VG |
| Ex. 30 | 72 | 0 | 2.8 | 1.1 | 2.3 | 2.0 | Yes | Yes | VG | VG | VG | VG | VG |
| Ex. 31 | 71 | 0 | 2.9 | 1.1 | 2.4 | 1.4 | Yes | Yes | VG | VG | VG | VG | VG |
| Ex. 32 | 72 | 0 | 2.8 | 1.0 | 2.4 | 3.2 | Yes | Yes | VG | G | VG | VG | G |
| Ex. 33 | 73 | 0 | 2.8 | 1.0 | 2.3 | 2.1 | Yes | Yes | VG | VG | VG | VG | VG |
| Ex. 34 | 72 | 0 | 2.8 | 1.0 | 1.0 | 2.4 | Yes | Yes | G | G | G | VG | G |
| Ex. 35 | 72 | 0 | 2.8 | 1.0 | 1.3 | 2.4 | Yes | Yes | G | G | G | VG | G |

VG: very good, G: good, F: fair, P: poor

TABLE 6

| | Free tin area rate % | Deposition Ni mg/m$^2$ | Free Sn g/m$^2$ | Alloy Sn g/m$^2$ | P mg/m$^2$ | Tin oxide mC/cm$^2$ | Tin phos-phate | Iron phos-phate | (A) Dry adhesion | (B) Secondary adhesion | (C) Corrosion resistance | (D) Appear-ance | Overall eval. |
|---|---|---|---|---|---|---|---|---|---|---|---|---|---|
| Ex. 36 | 72 | 0 | 2.8 | 1.0 | 1.7 | 2.5 | Yes | Yes | G | G | G | VG | G |
| Ex. 37 | 72 | 0 | 2.8 | 1.0 | 2.1 | 2.4 | Yes | Yes | VG | VG | VG | VG | VG |
| Ex. 38 | 72 | 0 | 2.8 | 1.0 | 2.6 | 2.4 | Yes | Yes | VG | VG | VG | VG | VG |
| Ex. 39 | 71 | 0 | 2.9 | 1.0 | 1.4 | 2.4 | Yes | Yes | G | G | G | VG | G |
| Ex. 40 | 72 | 0 | 2.8 | 1.0 | 1.6 | 2.5 | Yes | Yes | G | G | G | VG | G |
| Ex. 41 | 72 | 0 | 2.8 | 1.0 | 2.1 | 2.4 | Yes | Yes | VG | VG | VG | VG | VG |
| Ex. 42 | 72 | 0 | 2.8 | 1.0 | 2.4 | 2.4 | Yes | Yes | VG | VG | VG | VG | VG |
| Ex. 43 | 72 | 0 | 2.8 | 1.0 | 3.1 | 2.4 | Yes | Yes | VG | VG | VG | VG | VG |
| Ex. 44 | 72 | 0 | 2.8 | 1.0 | 2.1 | 3.0 | Yes | Yes | VG | VG | VG | VG | VG |
| Ex. 45 | 71 | 0 | 2.8 | 1.0 | 2.1 | 1.7 | Yes | Yes | VG | VG | VG | VG | VG |
| Ex. 46 | 72 | 0 | 2.8 | 1.0 | 2.2 | 1.1 | Yes | Yes | VG | VG | VG | VG | VG |
| Ex. 47 | 71 | 0 | 2.8 | 1.0 | 1.6 | 2.5 | Yes | Yes | G | G | G | VG | G |
| Ex. 48 | 72 | 0 | 2.8 | 1.0 | 1.9 | 2.4 | Yes | Yes | VG | VG | VG | VG | VG |
| Ex. 49 | 72 | 0 | 2.8 | 1.0 | 2.3 | 2.4 | Yes | Yes | VG | VG | VG | VG | VG |
| Ex. 50 | 71 | 0 | 2.8 | 1.0 | 2.7 | 2.4 | Yes | Yes | VG | VG | VG | VG | VG |
| Ex. 51 | 71 | 0 | 2.8 | 1.0 | 3.6 | 2.4 | Yes | Yes | VG | G | VG | VG | G |
| Ex. 52 | 71 | 0 | 2.9 | 1.0 | 1.7 | 2.4 | Yes | Yes | G | G | G | VG | G |
| Ex. 53 | 72 | 0 | 2.8 | 1.0 | 1.9 | 2.4 | Yes | Yes | VG | VG | VG | VG | VG |
| Ex. 54 | 72 | 0 | 2.8 | 1.0 | 3.1 | 2.5 | Yes | Yes | VG | VG | VG | VG | VG |
| Ex. 55 | 72 | 0 | 2.8 | 1.0 | 4.2 | 2.6 | Yes | Yes | G | G | G | VG | G |
| Ex. 56 | 72 | 0 | 2.8 | 1.0 | 2.4 | 3.6 | Yes | Yes | G | G | G | VG | G |
| Ex. 57 | 73 | 0 | 2.8 | 1.0 | 2.3 | 3.5 | Yes | Yes | G | G | G | VG | G |
| Ex. 58 | 72 | 0 | 2.8 | 1.1 | 2.4 | 3.0 | Yes | Yes | VG | VG | VG | VG | VG |
| Ex. 59 | 72 | 0 | 2.8 | 1.0 | 2.4 | 1.5 | Yes | Yes | VG | VG | VG | VG | VG |
| Ex. 60 | 71 | 0 | 2.8 | 1.0 | 2.4 | 1.0 | Yes | Yes | VG | VG | VG | VG | VG |
| Ex. 61 | 72 | 0 | 2.9 | 1.1 | 2.4 | 3.4 | Yes | Yes | G | G | G | VG | G |
| Ex. 62 | 71 | 0 | 2.8 | 1.0 | 2.3 | 1.0 | Yes | Yes | VG | VG | VG | VG | VG |

TABLE 6-continued

| | Free tin | Deposition | | | | Tin | Tin | Iron | (A) | (B) | (C) | (D) | |
|---|---|---|---|---|---|---|---|---|---|---|---|---|---|
| | area rate % | Ni mg/m$^2$ | Free Sn g/m$^2$ | Alloy Sn g/m$^2$ | P mg/m$^2$ | oxide mC/cm$^2$ | phos-phate | phos-phate | Dry adhesion | Secondary adhesion | Corrosion resistance | Appear-ance | Overall eval. |
| Ex. 63 | 72 | 0 | 2.8 | 1.0 | 2.1 | 2.5 | Yes | Yes | VG | VG | VG | VG | VG |
| Ex. 64 | 72 | 0 | 2.8 | 1.0 | 2.5 | 2.5 | Yes | Yes | VG | VG | VG | VG | VG |
| Ex. 65 | 72 | 0 | 2.8 | 1.0 | 2.9 | 2.5 | Yes | Yes | VG | VG | VG | VG | VG |
| Ex. 66 | 71 | 0 | 2.8 | 1.0 | 3.5 | 2.5 | Yes | Yes | VG | G | VG | VG | G |
| Ex. 67 | 71 | 0 | 2.8 | 1.0 | 4.5 | 2.5 | Yes | Yes | G | G | G | VG | G |
| Ex. 68 | 72 | 0 | 2.8 | 1.0 | 2.6 | 2.5 | Yes | Yes | VG | VG | VG | VG | VG |
| Ex. 69 | 72 | 0 | 2.8 | 1.0 | 3.2 | 2.4 | Yes | Yes | VG | VG | VG | VG | VG |
| Ex. 70 | 72 | 0 | 2.8 | 1.0 | 3.9 | 2.5 | Yes | Yes | G | G | G | VG | G |

VG: very good, G: good, F: fair, P: poor

TABLE 7

| | Free tin | Deposition | | | | Tin | Tin | Iron | (A) | (B) | (C) | (D) | |
|---|---|---|---|---|---|---|---|---|---|---|---|---|---|
| | area rate % | Ni mg/m$^2$ | Free Sn g/m$^2$ | Alloy Sn g/m$^2$ | P mg/m$^2$ | oxide mC/cm$^2$ | phos-phate | phos-phate | Dry adhesion | Secondary adhesion | Corrosion resistance | Appear-ance | Overall eval. |
| Ex. 71 | 72 | 0 | 2.8 | 1.0 | 4.3 | 2.5 | Yes | Yes | G | G | G | VG | G |
| Ex. 72 | 72 | 0 | 2.8 | 1.0 | 4.9 | 2.5 | Yes | Yes | G | G | G | VG | G |
| Ex. 73 | 72 | 0 | 2.8 | 1.0 | 2.1 | 2.8 | Yes | Yes | VG | VG | VG | VG | VG |
| Ex. 74 | 72 | 0 | 2.8 | 1.0 | 2.1 | 2.1 | Yes | Yes | VG | VG | VG | VG | VG |
| Ex. 75 | 71 | 0 | 2.8 | 1.0 | 2.1 | 1.3 | Yes | Yes | VG | VG | VG | VG | VG |
| Ex. 76 | 71 | 0 | 2.8 | 1.0 | 2.2 | 0.7 | Yes | Yes | VG | VG | VG | VG | VG |
| Ex. 77 | 72 | 0 | 2.8 | 1.0 | 2.4 | 3.4 | Yes | Yes | G | G | G | VG | G |
| Ex. 78 | 72 | 0 | 2.8 | 1.0 | 2.4 | 3.3 | Yes | Yes | VG | G | VG | VG | G |
| Ex. 79 | 72 | 0 | 2.8 | 1.1 | 2.4 | 2.8 | Yes | Yes | VG | VG | VG | VG | VG |
| Ex. 80 | 71 | 0 | 2.8 | 1.1 | 2.4 | 2.1 | Yes | Yes | VG | VG | VG | VG | VG |
| Ex. 81 | 72 | 0 | 2.8 | 1.1 | 2.3 | 1.1 | Yes | Yes | VG | VG | VG | VG | VG |
| Ex. 82 | 72 | 0 | 2.8 | 1.1 | 2.4 | 0.7 | Yes | Yes | VG | VG | VG | VG | VG |
| Ex. 83 | 71 | 0 | 2.8 | 1.0 | 2.1 | 2.6 | Yes | Yes | VG | VG | VG | VG | VG |
| Ex. 84 | 72 | 0 | 2.8 | 1.0 | 2.2 | 1.8 | Yes | Yes | VG | VG | VG | VG | VG |
| Ex. 85 | 72 | 0 | 2.8 | 1.0 | 2.1 | 0.7 | Yes | Yes | VG | VG | VG | VG | VG |
| Ex. 86 | 72 | 0 | 2.8 | 1.0 | 2.2 | 0.4 | Yes | Yes | VG | VG | VG | VG | VG |
| Ex. 87 | 72 | 0 | 2.8 | 1.1 | 2.4 | 3.3 | Yes | Yes | VG | G | VG | VG | G |
| Ex. 88 | 72 | 0 | 2.8 | 1.0 | 2.4 | 3.2 | Yes | Yes | VG | G | VG | VG | G |
| Ex. 89 | 72 | 0 | 2.8 | 1.1 | 2.4 | 2.7 | Yes | Yes | VG | VG | VG | VG | VG |
| Ex. 90 | 72 | 0 | 2.8 | 1.1 | 2.3 | 1.8 | Yes | Yes | VG | VG | VG | VG | VG |
| Ex. 91 | 72 | 0 | 2.8 | 1.0 | 2.4 | 0.7 | Yes | Yes | VG | VG | VG | VG | VG |
| Ex. 92 | 73 | 0 | 2.8 | 1.1 | 2.4 | 0.35 | Yes | Yes | VG | VG | VG | VG | VG |
| Ex. 93 | 72 | 0 | 2.8 | 1.0 | 3.8 | 2.5 | Yes | Yes | VG | G | VG | VG | G |
| Ex. 94 | 73 | 0 | 2.8 | 1.0 | 2.1 | 2.5 | Yes | Yes | VG | VG | VG | VG | VG |
| Ex. 95 | 73 | 0 | 2.8 | 1.0 | 2.4 | 2.5 | Yes | Yes | VG | VG | VG | VG | VG |
| Ex. 96 | 72 | 0 | 2.8 | 1.0 | 2.3 | 2.5 | Yes | Yes | VG | VG | VG | VG | VG |
| Ex. 97 | 72 | 0 | 2.8 | 1.0 | 2.4 | 2.4 | Yes | Yes | VG | VG | VG | VG | VG |
| Ex. 98 | 72 | 0 | 2.8 | 1.0 | 2.4 | 2.5 | Yes | Yes | VG | VG | VG | VG | VG |
| Ex. 99 | 71 | 3 | 1.1 | 0.4 | 2.4 | 2.5 | Yes | Yes | VG | VG | VG | VG | VG |
| Ex. 100 | 71 | 15 | 1.1 | 0.5 | 2.4 | 2.5 | Yes | Yes | VG | VG | VG | VG | VG |
| Ex. 101 | 72 | 96 | 1.1 | 0.6 | 2.4 | 2.5 | Yes | Yes | VG | VG | VG | VG | VG |
| Ex. 102 | 70 | 3 | 1.1 | 0.4 | 2.4 | 2.5 | Yes | Yes | VG | VG | VG | VG | VG |
| Ex. 103 | 72 | 15 | 1.1 | 0.3 | 2.4 | 2.5 | Yes | Yes | VG | VG | VG | VG | VG |
| Ex. 104 | 71 | 97 | 1.1 | 0.3 | 2.4 | 2.5 | Yes | Yes | VG | VG | VG | VG | VG |

VG: very good, G: good, F: fair, P: poor

TABLE 8

| | Free tin | Deposition | | | | Tin | Tin | Iron | (A) | (B) | (C) | (D) | |
|---|---|---|---|---|---|---|---|---|---|---|---|---|---|
| | area rate % | Ni mg/m$^2$ | Free Sn g/m$^2$ | Alloy Sn g/m$^2$ | P mg/m$^2$ | oxide mC/cm$^2$ | phos-phate | phos-phate | Dry adhesion | Secondary adhesion | Corrosion resis tance | Appear-ance | Overall eval. |
| Comp. Ex. 1 | 72 | 0 | 2.9 | 1.1 | 2.4 | 5.2 | Yes | Yes | G | P | F | VG | P |
| Comp. Ex. 2 | 72 | 0 | 2.9 | 1.1 | 0.9 | 4.3 | Yes | Yes | F | P | P | VG | P |
| Comp. Ex. 3 | 72 | 0 | 2.9 | 1.1 | 0 | 6.8 | No | Yes | P | P | P | VG | P |

TABLE 8-continued

| | Free tin | Deposition | | | | Tin | Tin | Iron | (A) | (B) | (C) | (D) | |
|---|---|---|---|---|---|---|---|---|---|---|---|---|---|
| | area rate % | Ni mg/m$^2$ | Free Sn g/m$^2$ | Alloy Sn g/m$^2$ | P mg/m$^2$ | oxide mC/cm$^2$ | phos-phate | phos-phate | Dry adhesion | Secondary adhesion | Corrosion resis tance | Appear-ance | Overall eval. |
| Comp. Ex. 4 | 72 | 0 | 2.9 | 1.1 | 2.4 | 4.5 | Yes | Yes | G | F | G | VG | F |
| Comp. Ex. 5 | 71 | 0 | 2.8 | 1.0 | 2.4 | 0.1 | Yes | Yes | VG | F | VG | VG | F |
| Comp. Ex. 6 | 72 | 0 | 2.8 | 1.0 | 0.8 | 2.5 | Yes | Yes | G | F | P | VG | P |
| Comp. Ex. 7 | 72 | 0 | 2.8 | 1.1 | 0.6 | 2.5 | Yes | Yes | G | F | P | VG | P |
| Comp. Ex. 8 | 71 | 0 | 2.8 | 1.0 | 5.8 | 2.5 | Yes | Yes | P | P | F | VG | P |
| Comp. Ex. 9 | 73 | 0 | 2.9 | 1.0 | 5.3 | 2.5 | Yes | Yes | F | P | F | F | P |
| Comp. Ex. 10 | 72 | 0 | 2.8 | 1.0 | 0.5 | 2.5 | Yes | Yes | G | P | P | VG | P |
| Comp. Ex. 11 | 2 | 0 | 0.4 | 0.1 | 2.4 | 2.5 | Yes | Yes | VG | VG | P | P | P |
| Comp. Ex. 12 | 100 | 0 | 11.2 | 1.2 | 2.4 | 2.5 | Yes | No | F | P | VG | VG | P |
| Comp. Ex. 13 | 72 | 0 | 2.8 | 1.0 | 5.5 | 2.3 | Yes | Yes | F | P | F | F | P |

VG: very good, G: good, F: fair, P: poor

Examples 1 to 104 of the present invention are examples which are "VG" or "G" in all evaluation items and overall evaluation and satisfy the sought performances.

Comparative Example 1 is an example only treated in a phosphate solution by cathodic electrolysis and anodic electrolysis and not treated by the second cathodic electrolysis. The amount of tin oxide was large, the secondary film adhesion was poor, and the corrosion resistance was also fair.

Comparative Example 2 is an example only treated in a phosphate solution by cathodic electrolysis and not treated by anodic electrolysis or the second cathodic electrolysis. The amount of phosphate film formed was small and the amount of tin oxide was large, so the dry adhesion was fair and the secondary adhesion and corrosion resistance were poor.

Comparative Example 3 is an example not electrolytically treated in a phosphate solution. Phosphate film was not formed and the amount of tin oxide was large, so all of the dry and secondary adhesion and the corrosion resistance were poor.

Comparative Example 4 is an example of treatment in a phosphate-solution by cathodic electrolysis, anodic electrolysis, and cathodic electrolysis, but with a low cathodic current density of the second cathodic electrolysis and a short electrolysis time. The amount of tin oxide was large and the secondary adhesion was fair.

Comparative Example 5 is an example of treatment in a phosphate solution by cathodic electrolysis, anodic electrolysis, and cathodic electrolysis, but with a high cathodic current density of the second cathodic electrolysis and also a long electrolysis time. The amount of tin oxide was too small and the secondary adhesion was fair.

Comparative Example 6 is an example of treatment in a phosphate solution by cathodic electrolysis, anodic electrolysis, and cathodic electrolysis, but with a low cathodic current density, of the first cathodic electrolysis and also a short electrolysis time. The anodic electrolysis was performed in the state with a large amount of tin oxide remaining, so the amount of phosphate film formed was small, the secondary adhesion was fair, and the corrosion resistance was also poor.

Comparative Example 7 is an example of treatment in a phosphate solution by cathodic electrolysis, anodic electrolysis, and cathodic electrolysis, but with a low anodic current density of the anodic electrolysis and also a short electrolysis time. The amount of phosphate film formed was small, the secondary adhesion was fair, and the corrosion resistance was also poor.

Comparative Example 8 is an example of treatment in a phosphate solution by cathodic electrolysis, anodic electrolysis, and cathodic electrolysis, but with a high anodic current density of the anodic electrolysis. The amount of phosphate film formed was large, the coating adhesion was poor, and the corrosion resistance was fair.

Comparative Example 9 is an example of treatment in a phosphate solution by cathodic electrolysis, anodic electrolysis, and cathodic electrolysis, but with a low pH of the treatment solution of 1.2. The amount of phosphate film formed was large, the dry coating adhesion was fair, the secondary adhesion was poor, and the corrosion resistance was also fair. Further, due to the treatment solution, part of the tin-plated surface dissolved and the appearance became fair.

Comparative Example 10 is an example of treatment in a phosphate solution by cathodic electrolysis, anodic electrolysis, and cathodic electrolysis, but with a high pH of the treatment solution of 4.1. The amount of phosphate formed was small, and the secondary adhesion and the corrosion resistance were poor.

Comparative Example 11 is an example where the coating weight of tin-plating was small and the free tin area rate was low. The acidic test solution entered the interface of the steel sheet and film and the corrosion resistance was poor. Further, the glossy appearance was poor.

Comparative Example 12 is an example of the entire surface being covered with free tin. The dry adhesion was fair, while the secondary adhesion was poor.

Comparative Example 13 is an example where no cations are added to the treating solution and a phosphate solution was applied. The pH could not be adjusted and the pH was a low (1.3), so the amount of phosphate film formed was large, the dry adhesion was fair, the secondary adhesion was poor, and the corrosion resistance was also fair. Further, the treatment solution caused the tin-plated surface to be etched whereby the appearance became fair.

INDUSTRIAL APPLICABILITY

As explained above, according to the present invention, it is possible to provide plated steel sheet for cans having a film structure with an extremely good secondary adhesion with an organic film and corrosion resistance and a method of production producing such a steel sheet at a low cost. Therefore, the present invention has high applicability in the plating industry.

The invention claimed is:

1. A tin-plated steel sheet for cans, comprising:

a steel sheet plated with a tin alloy layer;

free tin distributed on said tin alloy layer in a 5 to 97% area rate; and a chemically treated layer comprising phosphate in an amount corresponding to 1.0 to 5.0 $mg/m^2$ of P, and tin oxide in an amount requiring 0.3 to 4.0 $mC/cm^2$ of electricity to reduce the tin oxide, the chemically treated layer formed on the tin alloy layer and free tin, wherein the phosphate includes iron phosphate and tin phosphate.

2. The tin-plated steel sheet for cans as set forth in claim 1, wherein the iron phosphate is formed on the tin alloy layer which is not covered with free tin.

3. The tin-plated steel sheet for cans as set forth in claim 1, wherein the tin phosphate is formed on the free tin.

4. The tin-plated steel sheet for cans as set forth in any one of claims 1 to 3, wherein said tin alloy layer comprises at least one of an Fe—Sn alloy layer containing Sn in an amount of 0.1 to 2.0 $g/m^2$ and an Fe—Ni—Sn alloy layer containing nickel in an amount of 2 to 100 $mg/m^2$.

5. The tin-plated steel sheet for cans as set forth in any one of claims 1 to 3, wherein a total of the free tin and tin in said tin alloy layer is 0.5 to 12 $g/m^2$.

* * * * *

UNITED STATES PATENT AND TRADEMARK OFFICE

CERTIFICATE OF CORRECTION

PATENT NO. : 8,518,555 B2
APPLICATION NO. : 12/735714
DATED : August 27, 2013
INVENTOR(S) : Hiromitsu Date It is certified that error appears in the above-identified patent and that said Letters Patent is hereby corrected as shown below:

In the Specification

Column 19, line 46, change “phosphate-solution” to -- phosphate solution --.

Signed and Sealed this
Fifth Day of August, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,518,555 B2
APPLICATION NO. : 12/735714
DATED : August 27, 2013
INVENTOR(S) : Hiromitsu Date It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 350 days.

Signed and Sealed this
Fifteenth Day of September, 2015

Michelle K. Lee

Michelle K. Lee
*Director of the United States Patent and Trademark Office*